United States Patent [19]

Alexander et al.

[11] Patent Number: 4,952,749

[45] Date of Patent: Aug. 28, 1990

[54] REMOVAL OF DIAMONDOID COMPOUNDS FROM HYDROCARBONACEOUS FRACTIONS

[75] Inventors: Richard A. Alexander; Charles E. Knight, both of Mobile, Ala.; Darrell D. Whitehurst, Titusville, N.J.

[73] Assignee: Mobil Oil Corp., New York, N.Y.

[21] Appl. No.: 358,760

[22] Filed: May 26, 1989

[51] Int. Cl.[5] ..... C07C 7/12; C07C 7/10

[52] U.S. Cl. ..... 585/803; 208/334; 208/335; 208/337; 208/341; 585/352; 585/825; 585/826; 585/867

[58] Field of Search ..... 585/352, 867, 823, 350, 585/803; 208/337, 334, 335, 341, 361

[56] References Cited

U.S. PATENT DOCUMENTS

| | | | |
|---|---|---|---|
| 2,666,500 | 1/1954 | Cohn et al. | 585/823 |
| 3,094,569 | 6/1963 | Thomas | 585/823 |
| 3,567,791 | 3/1971 | Fuller | 585/857 |
| 4,083,772 | 4/1978 | Asselin et al. | 585/857 |
| 4,793,545 | 1/1989 | Schmidt | 585/823 |

OTHER PUBLICATIONS

"Operating Problems in the Hanlan Swan Hills Gas Field", by W. J. King, presented at the SPE Gas Technology Symposium Jun. 13–16, 1988, Dallas, TX.

K. Tominaga et al., "Next Generation Fine Chemicals Raw Material–Adamantane", Chemical Economy & Engineering Review, vol. 17, No. 10, pp. 23–30 (1985).

R. C. Fort, Jr., The Chemistry of Diamond Molecules, Marcel Dekker (1976).

*Primary Examiner*—Asok Pal

*Attorney, Agent, or Firm*—Alexander J. McKillop; Charles J. Speciale; Robert B. Furr, Jr.

[57] ABSTRACT

A process for recovering diamondoid compounds from a fluid mixture thereof with other hydrocarbonaceous compounds which comprises contacting said mixture with a porous solid, for example, a zeolite, having pore opening large enough to admit said diamondoid compounds thereinto and small enough so that at least 50% of the external atoms of said diamondoid compounds are capable of simultaneously contacting the internal walls of the pores of said solid under conditions conducive to absorption of diamondoid compounds by said solid; and then desorbing the absorbate comprising diamondoid compounds from said solid absorbant.

35 Claims, 1 Drawing Sheet

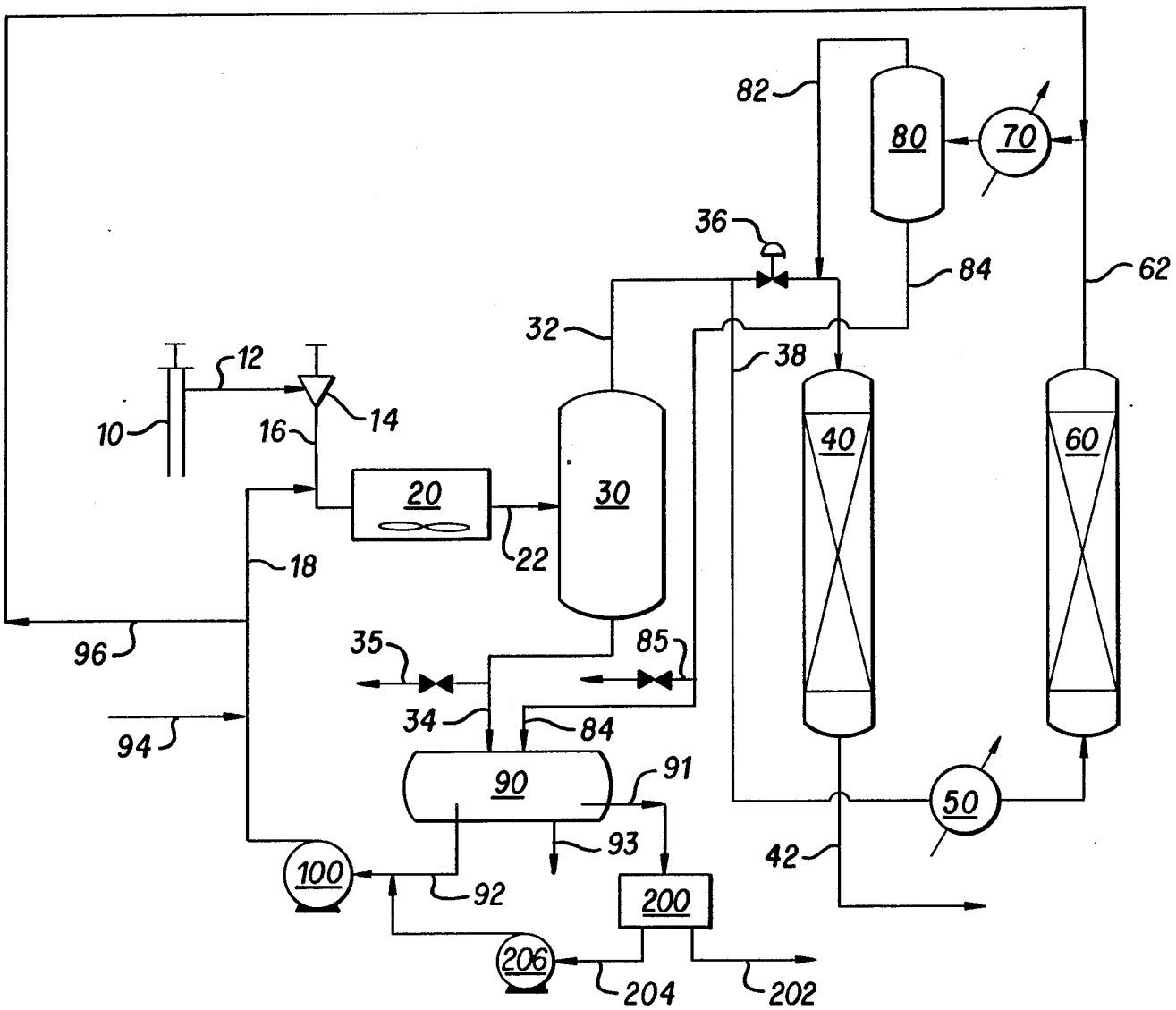
62
60
70
80
84
50
40
82
36
38
42
202
200
204
206
30
85
91
93
84
32
22
90
92
20
34
35
14
100
16
18
12
10
96
94

REMOVAL OF DIAMONDOID COMPOUNDS FROM HYDROCARBONACEOUS FRACTIONS

CROSS-REFERENCE TO RELATED APPLICATIONS

The present application is related by are disclosure of similar subject matter of commonly-assigned applications Ser. Nos. 358,758, 358,759 and 358,761, filed concurrently herewith.

BACKGROUND OF THE INVENTION

This invention relates to the removal of certain components from hydrocarbon streams. It more particularly refers to separating diamondoid compounds from hydrocarbon streams containing such.

Many hydrocarbonaceous mineral streams contain some small proportion of diamondoid compounds. These high boiling, saturated, polycyclic organics are illustrated by adamantane, diamantane, triamantane and various side chain substituted homologues, particularly the methyl derivatives. These compounds have high melting points and high vapor pressures for their molecular weights and often cause problems during production and refining of hydrocarbonaceous minerals, particularly natural gas, by condensing out and solidifying, thereby clogging pipes and other pieces of equipment. For a survey of the chemistry of diamondoid compounds, see Fort, Jr., Raymond C., *The Chemistry of Diamond Molecules*, Marcel Dekker, 1976.

In recent times, new sources of hydrocarbon minerals have been brought into production which, for some unknown reason, have substantially larger concentrations of diamondoid compounds. Whereas in the past, the amount of diamondoid compounds has been too small to cause operational problems such as production cooler plugging, now these compounds represent both a larger problem and a larger opportunity. The presence of diamondoid compounds in natural gas has been found to cause plugging in the process equipment requiring costly maintenance downtime to remove. On the other hand, these very compounds which can deleteriously affect the profitability of natural gas production are themselves valuable products.

BROAD STATEMENT OF THE INVENTION

According to this invention, it has now been found that it is possible under some conditions to concentrate diamondoid compound containing streams. Thus it has been found that distillate fuel oil fractions which have a significant aromatic compound content, such as monocyclic aromatics, are good solvents for diamondoid compounds and thus can be used as a wash for the equipment used in production and refining of such source.

Therefore, whether the original hydrocarbonaceous mineral is itself a fluid, or solid diamondoid compounds have been dissolved in aromatic distillate fuel oil or other solvents, there is presented for resolution by the practice of this invention, a substantially hydrocarbonaceous fluid of mixed composition containing a recoverable proportion of diamondoid compounds, which are not readily separable from the hydrocarbonaceous fluid by conventional distillation means, in admixture with aromatic components as well as aliphatic fractions.

This invention comprises contacting such a substantially hydrocarbonaceous fluid under absorption conditions, with a particular class of porous solid materials having a defined set of properties vis: a pore system large enough and having a suitable shape to be receptive to the rather bulky diamondoid compounds. These diamondoid compounds are very bulky because they contain at least three (3) mutually fused cyclohexane rings.

It should be understood that the operation of this invention is not based exclusively on shape selective absorption phenomena, a well known and widely used attribute of most porous solids. Certainly shape selective absorption plays an important part in this process—a molecule which is too large to fit into the pore of a solid cannot be absorbed in that pore. However, it has been found that porous solids which conform to the properties hereinabove set forth absorb diamondoid compounds preferentially even with respect to smaller hydrocarbon compounds which would be believed to be more readily absorbed if considered on a pure size based shape selectivity alone.

The invention provides a process by which diamondoid compounds may be extracted from hydrocarbonaceous gas streams by contacting the gas stream with a liquid solvent in which diamondoid compounds are at least partially soluble and then separating the diamondoid compounds from the enriched liquid solvent via zeolite absorption. Solvents useful in the solvation process of the invention include normally liquid hydrocarbons containing aromatics including petroleum-based solvents such as kerosene, diesel fuel, and heavy gasoline, with diesel fuel being the most preferred solvent.

The invention further provides a sorption process for extracting diamondoid compounds from a diamondoid-containing gas stream by first sorbing the diamondoid compounds with silica gel, then desorbing the diamondoid compounds from the silica gel with a regeneration fluid, and separating diamondoid compounds from the regeneration fluid via sorption with a porous solid, for example, a zeolite. This aspect of the invention comprises the steps of providing a gas stream containing a recoverable concentration of diamondoid compounds, contacting the diamondoid-containing gas stream with silica gel in a sorption zone under conditions of temperature and pressure to prevent substantial formation of solid diamondoid desposits in the sorption zone for a period of time sufficient for the silica gel to sorb at least a portion of the diamondoid compounds from the hydrocarbon gas, regenerating the silica gel by contacting the silica gel with a regeneration fluid in which diamondoid compounds are at least partially soluble to desorb diamondoid compounds from the silica gel, separating diamondoid compounds from the regeneration fluid by contacting the regeneration fluid with a porous solid absorbent, for example, a zeolite.

The preferred embodiment of the invention includes both the solvation and silica gel sorption stages as well as the zeolite absorption stage, providing a process for extracting diamondoid compounds from a diamondoid-containing gas stream comprising the steps of providing a gas stream containing a recoverable concentration of diamondoid compounds, mixing the gas stream containing diamondoid compounds with a solvent in which diamondoid compounds are at least partially soluble, controlling the conditions including temperature and pressure of the mixture to maintain at least a portion of the mixture in the liquid phase, separating the mixture under the controlled conditions into a partially purified gas stream and a diamondoid-enriched solvent stream, recovering diamondoid compounds from the diamondoid-enriched solvent stream by contacting the diamondoid-enriched solvent stream with a zeolite absorbent for a period of time sufficient for the zeolite absorbent to absorb at least a portion of the diamondoid compounds from the diamondoid-enriched solvent stream, contacting the partially purified gas stream with silica gel in a first sorption zone under conditions of temperature and pressure to prevent substantial formation of solid diamondoid desposits in the sorption zone for a period of time sufficient for the silica gel to sorb at least a portion of the diamondoid compounds from the hydrocarbon gas, and recovering diamondoid compounds from silica gel by desorption in a second sorption zone by contacting the silica gel with a regeneration fluid in which diamondoid compounds are at least partially soluble to desorb diamondoid compounds from the silica gel, and separating diamondoid compounds from the regeneration fluid by contacting at least a portion of the regeneration fluid with a zeolite absorbent for a period of time sufficient for the zeolite absorbent to absorb at least a portion of the diamondoid compounds from the regeneration fluid.

DESCRIPTION OF THE DRAWING

The FIGURE is a simplified schematic showing major processing steps of a preferred embodiment of the present invention.

DETAILED DESCRIPTION

The porous solids having the proper, desirable pore structures and sizes adapted to be useful in this invention can be identified through theoretical considerations or by simple experimentation. Thus models, real or synthesized by a computer, can be constructed, as can models of diamondoid compounds. These models can be interacted to determine their compliance with the required critical parameters set forth above.

Alternatively, synthetic mixtures of diamondoid compounds (suitably equilibrium mixtures thereof) admixed with lighter (smaller) hydrocarbons, such as lower paraffins, can be contacted with various porous solids to determine practically which porous solids have the desired absorption properties. As noted, the best porous solid absorbents will absorb diamondoid compounds even preferentially to lighter aliphatics.

Another alternative approach to determining the applicability of any particular porous solid to use in this invention is a theoretical consideration of pore sizes and configurations of the porous solid compared to molecule sizes and configurations of the diamondoid compounds to be absorbed. The pore shapes and sizes of most porous solids have been thoroughly studied and published. Similarly, the shapes and dimensions of most known molecules have been measured and the results thereof published. Theoretical comparisons are therefor possible in many cases.

In many instances some combination of these described means of determining which porous solids to use in practicing this invention will be found to be appropriate. Illustrative solids include zeolite crystals having pore structures composed of 24 to 36 atom rings. Of these ring atoms, half are chalcogens, e.g., oxygen and/or sulfur, and the other half are metals such as silicon, aluminum, boron, phosphorous, gallium, and/or iron. This list is illustrative and not limiting.

Zeolitic crystal structures containing some or all of these elements which have been found to be operative within the precepts of this invention include those which are commonly called 12 to 18 ring zeolites. Within this group, zeolitic structures referred to as faujasite, mazzite, offretite, mordenite, gmelinite, Linde L, ZSM-4, ZSM-12, ALPO-5, MAPSO-46, Co APO-50, VPI-5, zeolite beta and MCM-9 are illustrative of the types of crystal structures which are suited to use in this invention.

It is preferred to practice this invention with crystalline zeolitic solids having interconnected, three dimensional channel/pore structures because this allows multiple access passageways into and out of the pore system thereby facilitating the absorption/desorption cycle upon which the practice of this invention relies. It is not, however limited to such three dimensional pore systems.

Suitable porous solids for use with the present invention typically have channel structures with minor radii of about 3–4 Angstroms. Porous solids having three dimensional pore systems useful with the present invention typically include those solids having channel structures with minor radii of about 3–4 Angstroms and cage structures defined by the interconnecting channels with cage structure minor radii of about 6–8 Angstroms. For examples of these porous solids, see W. M. Meier and D. H. Olson, *Atlas of Zeolite Structure Types*, published by Butterworths on behalf of the Structure Commission of the International Zeolite Association, 1987, the text of which is incorporated herein by reference.

The zeolite absorption aspects of the invention can be practiced in a continuous process, in a batch process or in a hybrid, continuous-batch process. In a batch process, the diamondoid containing fluid, preferably liquid, is contacted with the absorbing porous solid for a time sufficient to reach absorption equilibrium, that is for the diamondoid compounds to absorb out of the fluid into the porous solid. Upon reaching equilibrium, the solid and fluid are separated, and the porous solid treated to desorb the diamondoid compounds therefrom. Upon all, or substantially all, of the diamondoid compounds being desorbed from the porous solid, it is suited to direct reuse to absorb additional diamondoid compounds, or it may need to be regenerated in order to make it reusable.

In a continuous process, diamondoid compound containing fluid may be continuously passed into contact with a fixed, fluidized or transport bed of suitable porous solid at a space velocity such that as much diamondoid compounds as desired is absorbed by the porous solid. In the case of a fixed bed absorber, the bed is periodically taken out of absorption service and regenerated to recover the diamondoid compound content thereof. A stirred bed reactor may be used in a similar way or it may have means to continuously or intermittently remove some of the porous solid from the bed for desorption while providing means to add make-up fresh or regenerated porous solid. A fixed-fluidized bed can operate similarly.

A transport bed reaction zone, by its fundamental nature, continuously removes porous solids from the absorption zone for desorption and recycling. In a fixed, stirred or fixed fluidized bed reaction zone type operation, multiple absorption zones can be used in a "swing bed" type operation where the feed is contacted with some bed or beds under absorption conditions while other bed or beds are being desorbed and/or regenerated.

The zeolite absorption zone according to this invention is suitably operated at a temperature of about 50° to 400° F., preferably at about 70° to 200° F. The pressure may be such as to keep the feed fluid and readily flowable. For example, pressures up to about 3000 psig have been found to be operative. Contact times, expressed as space velocity, of about 1 to 30, preferably 2 to 10 LHSV have been found to be suitable. The combination of these operating parameters should be adjusted to produce whatever recovery and product purity is desired. Clearly longer contact times will absorb more diamondoid compounds but the purity of absorbate may be lower.

This invention is useful in lowering the concentration of diamondoid compound in the feed hydrocarbonaceous fluid as much as possible—in other words substantially removing all of the diamondoid compounds from the feed. To accomplish this with hydrocarbonaceous mineral fluid feeds may require a zeolite absorbant having as much as 10 times or more of absorption capacity than is actually absorbed by the zeolite before regeneration of the zeolite absorbent. In many cases a ratio of zeolite absorption capacity utilized to total zeolite absorption capacity of about 2 to 10, has been found suitable, while in other cases as low a ratio as 1.5 may be sufficient.

In situations where the diamondoid compound content of the porous solid is the limiting factor in the process, the ratio of absorption capacity utilized to the total absorption capacity can be as low as 0.5 or even lower, for example, 0.2 to 0.05. If it is desired to accomplish both results, that is remove much or substantially all the diamondoid compounds from the feed, and produce a product containing a very high diamondoid compound content, a multistep operation has been found to be effective. In this latter case, multiple beds of zeolite absorbant are sequenced so that the early bed(s) in the train are designed to remove substantially all the diamondoid compounds from the feed even at the expense of absorbate purity. When these beds are put into their desorption cycle, the desorbed effluent is passed through bed(s) designed to concentrate the diamondoid compounds, so that when these later beds are desorbed, a substantially purified and concentrated diamondoid compound product is produced.

Desorption of the absorbed diamondoid compounds can be accomplished by heating, steam stripping, washing with a selective solvent or combination thereof. Other known desorption techniques which suggest themselves may be used.

Where selective solvent washing is used to desorb the diamondoid absorbate from the porous solid, according to this invention, representative solvents are illustrated by light paraffins, aromatic hydrocarbons, simple alcohols, lower ketones, ethers and carbon dioxide. This list is not exhaustive but merely illustrative. Preferred washing solvents include, in addition to the aforementioned carbon dioxide, propane, butanes, pentanes, hexanes, cyclohexanes, methyl cyclopentane, benzene, toluene, xylene, methanol, ethanol, propanols, butanols, acetone, methyl ethyl ketone, dimethyl ether, diethyl ether, methyl ethyl ether, mixtures of two or more of such compounds and/or fractions containing sufficiently high proportions of such compound(s) to be good washing solvents.

DESCRIPTION OF THE PREFERRED EMBODIMENT

Referring now to the Figure, a preferred embodiment of the present invention is schematically illustrated. A diamondoid-laden natural gas stream 12 is withdrawn from wellhead 10 at high pressure, generally between about 3000 and 15,000 psig, typically around 11,000 psig. Pressure reduction valve 14, commonly referred to as a choke, reduces the natural gas pressure downstream of the choke to between about 900 and about 1400 psig. Recycled solvent 18 is injected into the reduced pressure diamondoid-laden natural gas stream 16 upstream of process cooler 20 to prevent deposition of diamondoid solids within the cooler. Process cooler 20 is typically an air cooled exchanger with extended heat exchange tube surface area, commonly known as a fin-fan exchanger.

Solvent injection rates of about 2 to 6 gallons per minute (GPM) at natural gas flowrates of 10 to 15 million standard cubic feet per day (MMSCF/D) have been found to be effective to reduce diamondoid deposition. Thus to achieve the desired diamondoid sorption in the added solvent, solvent charge rates of about 100 to 1000 gallons per million standard cubic feet of natural gas (G/MMSCF) are acceptable, and rates of between about 200 and 800 G/MMSCF are preferred. The optimum charge rate within the disclosed ranges to minimize solvent costs while preventing diamondoid deposition in the downstream process equipment may be determined by one of ordinary skill in the art with a reasonable amount of trial and error.

If the solvent dosage selected for process operation is insufficient to maintain the diamondoids in solution through the process cooler, or if solvent injection is temporarily discontinued for operational reasons such as injection pump failure, diamondoids will likely be deposited on the inner surfaces of the process cooler heat exchange tubes, increasing the pressure drop across the air cooled exchanger. Thus one recommended method for determining optimum solvent dosage would be to monitor the change in natural gas pressure ($\Delta P$) across the process cooler with respect to time. An decrease in the $\Delta P$ across the process cooler would likely indicate diamondoid deposition on the inner surfaces of the cooler tubes and could be corrected with increased solvent dosage. The technique of monitoring heat exchanger operation by evaluating $\Delta P$ over time is well known to those skilled in the art of heat exchanger design and maintenance.

Depending on the concentration of diamondoid compounds in the natural gas stream as well as on the operating temperature and pressure, discontinuation of the solvent charge may precipitate partial or complete plugging of at least a portion of the process cooler heat exchange tubes. Such deposits may be removed via intermittent high dosage or "slug" solvent treatment. Slug solvent treatment has been found to be effective for removing diamondoid deposits from process cooler heat exchange tubes, e.g., charging 50 to 100 gallon slugs of solvent intermittently into the 10 to 15 MMSCF/D natural gas stream at a point upstream of the process cooler. The slugged solvent is then recovered by a method similar to that used for the continuously injected solvent, which method is described below.

The cooled mixture of natural gas and solvent 22 flows to production separator 30 where it is flashed to form an overhead vapor stream 32 and a bottom liquid stream 34. Production separator 30 is illustrated as a flash drum, i.e. a single stage vapor-liquid separation device, but may also comprise any suitable vapor-liquid separation apparatus known to those skilled in the art of process equipment design.

A first portion of the overhead vapor stream 32 flows through control valve 36 to enter sorption zone 40 while a second portion of the overhead vapor stream flow is preferably diverted by control valve 36 to form regeneration gas stream 38. The total overhead vapor stream may be charged to the sorption zone if an inert gas stream for use as a regeneration gas is both inexpensive and easily piped into the sorption process equipment. It is generally preferred, however, to use a portion of the overhead vapor stream as a regeneration gas due to its inherent economony and availability. Regeneration gas flow to the silica gel sorption zone is preferably countercurrent, i.e., gas flow for silica gel desorption during regeneration should be oriented in the opposite direction from gas flow for silica gel sorption during gas purification operation.

The first portion of the overhead vapor stream 32 then contacts a silica gel sorbent contained in sorption zone 40. The overhead vapor stream preferably flows downwardly in contact with the silica gel sorbent throught the length of the sorption zone 40. Silica gel volume is preferably selected such that almost all of the silica gel sorption capacity is utilized before regeneration.

The purified gas stream 42 is then withdrawn from sorption zone 40 and charged to pipeline or storage facilities. The second portion of the overhead vapor stream is preferably diverted for use as a regeneration gas as described above. Part of the purified gas stream 42 may be compressed and heated for use as a regeneration gas (compression equipment not shown). Regenerating silica gel using the purified gas effluent, for example from sorption zone 40, may prolong the silica gel useful life by decreasing the rate of steam deactivation. Regeneration gas 38 is heated in regeneration heat exchanger 50 to a temperature less than 315° C. (600° F.), preferably between about 177° and 288° C. (350° and 550° F.) and then charged to the bottom of sorption zone 60 to countercurrently desorb water and heavy hydrocarbons, particularly diamondoids, from the silica gel. The length of the regeneration step is a function of regeneration gas temperature and flowrate as well as the amount of sorbed material contained in the silica gel sorption bed. These operating parameters may be varied to synchronize the regeneration cycle (desorption) of a first sorption zone with the gas purification cycle (sorption) of a second sorption zone. The sorption zones are preferably piped and valved in a parallel configuration such that one sorption zone may be operated in the gas purification mode while the other sorption zone is countercurrently regenerated.

Enriched regeneration gas 62 is cooled to a temperature of between about 24° and 60° C. (75° and 140° F.) in regeneration cooler 70 and is flashed in regeneration separator 80 to form a overhead gas stream 82 and a liquid bottom stream 84. The overhead gas stream is preferably recycled and mixed with the production separator overhead stream and purified in sorption zone 40. The regeneration separator overhead gas stream 82 may optionally be mixed with purified gas stream 42. While such optional configuration beneficially reduces the total gas flow through the sorption zone operating in the gas purification mode, it necessarily reduces both diamondoid compound recovery and natural gas product purity.

Liquid bottom stream 34 from production separator 30 and 84 from regeneration separator 80 normally flow to solvent accumulator drum 90. A portion of the diamondoid-containing solvent 91 is drawn off the solvent accumulator and fresh solvent 94 is added downstream to maintain diamondoid concentration in the solvent below saturation. The diamondoid-containing draw stream 91 is then contacted with a zeolite absorbent in a batch or continuous zeolite absorption process 200 as described above and represented schematically in the Figure. The diamondoid compounds are then stripped off the zeolite absorbent as described above and withdrawn in a diamondoid-enriched stream 202. The purified solvent stream 204 is then recycled through pump 206 into diamondoid-containing solvent stream 92.

A water stream 93 is drawn off from solvent accumulator drum 90 and is sent to the process sewer for treatment and hydrocarbon recovery. The remaining diamondoid-containing solvent 92 is withdrawn from solvent accumulator drum 90, charged through pump 100 and mixed with fresh solvent 94 to form recycled solvent stream 18 which is added to the natural gas stream 16 upstream from process cooler 20 as described above.

A slip stream of diamondoid-containing solvent 96 may optionally be diverted from recycled solvent stream 18 and mixed with the enriched regeneration gas stream 62 upstream of regeration cooler 70. This slip stream addition to the enriched regeneration gas stream may be necessary to avoid diamondoid deposition in the regeneration gas cooler.

Changes and modifications in the specifically described embodiments can be carried out without departing from the scope of the invention which is intended to be limited only by the scope of the appended claims.

What is claimed is:

1. A process for recovering diamondoid compounds from a fluid mixture thereof with other hydrocarbonaceous compounds which comprises contacting said mixture with a porous solid having pore opening large enough to admit said diamondoid compounds thereinto and small enough so that at least about 50% of the external atoms of said diamondoid compounds are capable of simultaneously contacting the internal walls of the pores of said solid under conditions conducive to absorption of diamondoid compounds by said solid; and then desorbing the absorbate comprising diamondoid compounds from said solid absorbant.

2. The process of claim 1 wherein said mixture comprises natural gas.

3. The process of claim 1 wherein said mixture comprises natural gas liquids.

4. The process of claim 1 wherein said mixture comprises a solution of said diamondoid compounds in aromatic distillate fuel oil.

5. The process of claim 1 wherein said absorption is carried out at about 50° to 400° F.

6. The process of claim 1 wherein said absorption is carried out at about 70° to 200° F.

7. The process of claim 5 wherein said absorption is carried out at a pressure such that said admixture is a liquid.

8. The process of claim 1 wherein said porous solid is a zeolite solid comprising pores having from about 24 to 36 atoms defining at least one pore system.

9. The process of claim 8 wherein said zeolite porous solid comprises at least one of silicon, aluminum, boron, phosphorous, gallium or iron.

10. The process of claim 8 wherein said zeolite porous solid has a topology corresponding to that of at least one of faujasite, mazzite, offretite, mordenite, gmelinite, Linde L, ZSM-12, ALPO-5, MAPSO-46, Co APO-50, VPI-5, zeolite beta, ZSM-4 or MCM-9.

11. The process of claim 1 wherein said porous solid contains channel structures having minor radii of about 3 to 4 Angstroms.

12. The process of claim 1 including contacting said mixture and said porous solid for a time sufficient for them to come to equilibrium.

13. The process of claim 1 wherein the ratio of utilized diamondoid absorption capacity to the total diamondoid absorption capacity of porous solid is between about 10 to 1 and about 1 to 20.

14. The process of claim 1 including separating porous solid containing absorbate comprising diamondoid compounds; and heating such for a time and at a temperature sufficient to desorb diamondoid compounds therefrom.

15. The process of claim 1 including separating porous solid containing absorbate comprising diamondoid compounds; and then steam stripping such to recover diamondoid compounds therefrom.

16. The process of claim 1 including separating porous solid containing absorbate comprising diamondoid compounds; washing such with a solvent to leach said diamondoid compounds out of said porous liquid; and then separating said diamondoid compounds from said solvent.

17. The process of claim 16 wherein said solvent is at least one selected from the group consisting of propane, butanes, pentanes, hexanes, cyclohexane, methyl cyclopentane, benzene, toluene, xylene, methanol, ethanol, prepanols, butanols, acetone, methyl ethyl ketone, dimethyl ether, diethyl ether, methyl ethyl ether and carbon dioxide and mixtures thereof.

18. The process of claim 16 including separating said diamondoid compounds from said solvent by distillation.

19. The process of claim 1 including absorbing at least a large fraction of diamondoid compounds from said mixture as an impure absorbate in a first porous solid; separating said diamondoid compound containing first porous solid from said admixture; desorbing said absorbate to form a first desorbate; absorbing diamondoid compounds from said first desorbate in a second porous solid under conditions sufficient to produce an absorbate having a higher concentration of diamondoid compounds; separating said diamondoid compound containing second porous solid from said first desorbate; and desorbing diamondoid compounds from said second porous solid.

20. The process of claim 19 wherein said first and second porous solids are the same.

21. The process of claim 1 wherein said absorption is carried out in a fixed bed.

22. The process of claim 1 carried out in a fixed fluidized bed.

23. The process of claim 1 carried in a transport bed.

24. The process of claim 1 having at least two beds of porous solids, one operating in an absorption mode and the other operating in a desorption mode.

25. A process for extracting diamondoid compounds from a natural gas stream comprising the steps of:

(a) providing a natural gas well containing a recoverable concentration of diamondoid compounds;

(b) withdrawing natural gas containing diamondoid compounds from said natural gas well of step (a), above;

(c) mixing said withdrawn natural gas with a solvent in which diamondoid compounds are at least partially soluble;

(d) controlling the conditions including temperature and pressure of said mixture of step (c) above to maintain at least a portion of said mixture in the liquid phase;

(e) separating said mixture under the controlled conditions of step (d), above into a vapor stream and a diamondoid-enriched solvent stream; and (f) recovering diamondoid compounds from said diamondoid-enriched solvent stream to produce a purified solvent stream by contacting said diamondoid-enriched solvent stream with a porous solid having pore opening large enough to admit said diamondoid compounds thereinto and small enough so that at least about 50% of the external atoms of said diamondoid compounds are capable of simultaneously contacting the internal walls of the pores of said solid under conditions conducive to absorption of diamondoid compounds by said solid; and then desorbing the absorbate comprising diamondoid compounds from said porous solid.

26. The process of claim 25 wherein step (d) further comprises cooling said mixture of step (c).

27. The process of claim 26 wherein said cooling step comprises reducing the temperature of said mixture of step (c) to a temperature between about 24° and 60° C. (75° and 140° F.).

28. The process of claim 25 further comprising recycling said purified solvent solvent of step (f) to at least partially saturate said solvent with diamondoid compounds.

29. The process of claim 26 further comprising depressuring said natural gas stream to a pressure of not more than 21,000 kPa (3000 psig).

30. A process for extracting diamondoid compounds from a diamondoid-containing gas stream comprising the steps of:

(a) providing a gas stream containing a recoverable concentration of diamondoid compounds;

(b) contacting said diamondoid-containing gas stream with silica gel in a sorption zone for a period of time sufficient for said silica gel to sorb at least a portion of said diamondoid compounds from said hydrocarbon gas;

(c) regenerating said silica gel by contacting said silica gel with a regeneration fluid in which diamondoid compounds are at least partially soluble to desorb diamondoid compounds from said silica gel; and (d) recovering diamondoid compounds from at least a portion of said regeneration fluid by contacting said regeneration fluid with a porous solid having pore opening large enough to admit said diamondoid compounds thereinto and small enough so that at least about 50% of the external atoms of said diamondoid compounds are capable of simultaneously contacting the internal walls of the pores of said solid under conditions conducive to absorption of diamondoid compounds by said solid; and then desorbing the absorbate comprising diamondoid compounds from said porous solid.

31. The process of claim 30 wherein said silica gel contacting step (b) is carried out under conditions of temperature and pressure to prevent substantial formation of solid diamondoid desposits in said sorption zone.

32. A process for extracting diamondoid compounds from a diamondoid-containing gas stream comprising the steps of:

(a) providing a gas stream containing a recoverable concentration of diamondoid compounds;

(b) mixing said gas stream containing diamondoid compounds with a solvent in which diamondoid compounds are at least partially soluble;

(c) controlling the conditions including temperature and pressure of said mixture of step (b) above to maintain at least a portion of said mixture in the liquid phase;

(d) separating said mixture under the controlled conditions of step (c), above into a partially purified gas stream and a diamondoid-enriched solvent stream;

(e) recovering diamondoid compounds from said diamondoid-enriched solvent stream;

(f) contacting said partially purified gas stream with silica gel in a first sorption zone for a period of time sufficient for said silica gel to sorb at least a portion of said diamondoid compounds from said hydrocarbon gas;

(g) recovering diamondoid compounds from silica gel in a second sorption zone by contacting said silica gel with a regeneration fluid in which diamondoid compounds are at least partially soluble to desorb diamondoid compounds from said silica gel; and (h) recovering diamondoid compounds from at least a portion of said regeneration fluid by contacting said regeneration fluid with a porous solid having pore opening large enough to admit said diamondoid compounds thereinto and small enough so that at least about 50% of the external atoms of said diamondoid compounds are capable of simultaneously contacting the internal walls of the pores of said solid under conditions conducive to absorption of diamondoid compounds by said solid; and then desorbing the absorbate comprising diamondoid compounds from said solid absorbant.

33. The process of claim 31 wherein said silica gel contacting step (f) is carried out under conditions of temperature and pressure to prevent substantial formation of solid diamondoid desposits in said first sorption zone.

34. The process of claim 32 wherein said solvent is a petroleum hydrocarbon.

35. The process of claim 33 wherein said solvent is diesel fuel.

* * * * *